US005513969A

United States Patent [19]

Arnold

[11] Patent Number: 5,513,969

[45] Date of Patent: May 7, 1996

[54] ROTARY PISTON MACHINE HAVING ENGAGING CYCLOIDAL GEARS

[76] Inventor: Felix Arnold, Langenthalerstr. 37, 69239 Neckarsteinach-Grein, Germany

[21] Appl. No.: 244,775

[22] PCT Filed: Dec. 9, 1992

[86] PCT No.: PCT/DE92/01025

§ 371 Date: Sep. 8, 1994

§ 102(e) Date: Sep. 8, 1994

[87] PCT Pub. No.: WO93/12325

PCT Pub. Date: Jun. 24, 1993

[30] Foreign Application Priority Data

Dec. 9, 1991 [DE] Germany ..... 41 40 570.6

[51] Int. Cl.[6] ..... F01C 1/08; F01C 21/16

[52] U.S. Cl. ..... 418/195; 418/20; 418/19

[58] Field of Search ..... 418/19, 20, 150, 418/195

[56] References Cited

U.S. PATENT DOCUMENTS

| | | | |
|---|---|---|---|
| 1,623,596 | 4/1927 | Holmes | 418/19 |
| 2,049,775 | 8/1936 | Holmes | 418/20 |
| 3,236,186 | 11/1966 | Wildhaber | 418/195 |
| 3,464,361 | 9/1969 | Voser | 418/150 |
| 3,492,974 | 2/1970 | Kreimeyer . | |

FOREIGN PATENT DOCUMENTS

| | | | |
|---|---|---|---|
| 296363 | 5/1913 | Germany . | |
| 1523728 | 11/1989 | U.S.S.R. | 418/19 |
| 1472291 | 5/1977 | United Kingdom . | |

*Primary Examiner*—Charles Freay

*Attorney, Agent, or Firm*—Edwin E. Greigg; Ronald E. Greigg

[57] ABSTRACT

The invention comprises a rotary piston machine, which functions as a pump, compressor or engine, and in which the cogs (45) of teeth (46) of a rotating control part travel over a cycloidal surface (44) of a cycloidal part (42) in order to define work chambers (28), wherein the cycloidal part (42) likewise rotates (FIG. 10).

21 Claims, 6 Drawing Sheets

ROTARY PISTON MACHINE HAVING ENGAGING CYCLOIDAL GEARS

The invention is based on a rotary piston machine, which functions as a pump, compressor or engine, as generically defined hereinafter.

Rotary piston machines of this generic type always have at least one wall portion, which is sealed off from another wall portion and moved, thereby enlarging or shrinking the work chambers. At least one wall portion is moved in a work-producing manner; that is, this moved wall portion outputs power to the operating medium, such as air, gas, oil, etc., or receives power from the operating medium. The other wall parts which serve to define the work chamber that do not actually transmit power, are often called blocking-off parts, even though they may actually have motion of their own or in other words may themselves be a moving wall part. It is accordingly not precluded that the work-producing and the blocking off wall portions can trade tasks. In each case, however, this involves angled-axis rotary piston machines, with a rotary axis position similar to that in cone wheels.

In a know rotary piston machine of this generic type (U.S. Pat. No. 3,856,440), the teeth facing one another are in principle embodied similarly and mesh with one another. The two parts are radially sealingly disposed in a housing with a spherical interior. A ball disposed in the center takes on the task of support for the tumbling motion resulting as the parts rotate relative to one another and also the task of radially sealing off the work chambers from the inside. In this rotary piston machine, functioning as a compressor or pump, the tooth cogs are embodied as convex or concave, or in other words the tooth flanks are slightly curved inward or outward, in order to achieve adequate sealing of the tooth cog from the flank of the tooth opposite it.

Aside from the fact that by using identical tooth structures for the intermeshing teeth, the work chambers cannot be sealed off cleanly and cannot be optimized, and the idle space is unavoidable, the production of this kind of toothing is extraordinarily complicated and expensive.

SUMMARY OF THE INVENTION

The rotary piston machine according to the invention has an advantage over the prior art that by the cooperation of a cycloidally shaped flank face or end face of the cycloid part and the tooth cogs of the other teeth of the control part, a desired positive engagement between the tooth cog and the opposite face is assured. Another advantage is that the axial position (within a conical jacket) of the cycloid part and control part relative to one another can be varied without hindrance to the sealing function.

Another advantage of the invention is that the rotary piston machine can be designed with an idle space ranging toward zero, which is not possible with the generic machine discussed above. Moreover, the ratio between the chamber-defining surfaces and the work chamber volume itself can be determined largely freely, which is likewise not possible in the prior art. Not least, there is a substantial advantage in the fact that the radius of the cog of the teeth on the control part can be largely freely designed.

Although it is known (U.S. Pat. No. 3,492,974) to use a pairing of a cycloidally designed running surface with teeth that have steep flanks in an internal combustion engine, nevertheless a ring, called a control part in the invention, is rotated relative to a housing and tumbles in the process. Thus, a central axis on the tooth ring is also present, which is not embodied with an angled axis to the blocking-off part but rather central-axially or straight-axially. Accordingly, a rotary piston machine of a completely different generic type is involved. Axial readjustability is not possible, nor is optimizing of the idle volume, nor a modification of the tooth cogs, quite aside from the fact that the teeth have a sharp burr on the cog that must accept strong moments without being capable of doing so. This known motor lacks the second rotating part.

In another advantageous feature of the invention, the working positions of the axes of rotation of the existing parts are variable independently of one another.

According to the invention it is also conceivable that other additional pairings of wheels are present; at least one of the parts likewise has radial teeth on its back side, and the radial teeth in turn cooperate with a further singly or doubly toothed rotating part. The prerequisite is that each housing surrounding these rotating parts have a radial seal with respect to the parts. For driving and being driven, i.e. for power input and power takeoff, shafts or ring gears can be used in a known manner, which are connected to the rotating parts or disposed on them and cooperate with other driving or driven apparatus. By changing the operating positions of the axes of rotation, it can be attained that the volumetric change for one part of the rotary piston machine is delayed or precedes the other, so that by making the work chambers communicate, graduated work is made possible, or mixed feeding can be done.

In an advantageous feature of the invention, there are two of the cycloidal part or control part, and between these parts of which there are two, the other part, in the form of a ring, is provided with a set of radial teeth or cycloidal running surfaces on both sides, and in another feature, at least two work chambers present on both sides of the ring can be made to communicate with one another. This results in a dual-action pump or engine, for instance, in which a control part with teeth on both sides is disposed between two absolutely synchronously rotating cycloidal parts; the control part again has one tooth difference from the doubly present part. Depending on whether a pump or an engine is involved, this control part may have a driving device or a driven or power takeoff device, or the driving and/or power takeoff can be effected via the doubly present cycloidal parts. The housing can act as a stator, in which both driven cycloidal parts are supported, at a suitable operating angle, between which parts, freely carried along and having a difference of one tooth per radial side, the control part rotates.

In a further advantageous feature of the invention, therefore, in the housing or in the control part, suitable conduits, optionally controlled during the rotation, are present for supplying or removing the operating media. As a result not only are additional valves dispensed with but scavenging in the centrifugal direction is also possible.

In another preferred feature of the invention, the radial jacket face of the parts is spherically embodied, wherein these parts are radially sealingly guided on a corresponding spherically embodied inside face of the housing. The spherical guidance, especially, creates the capability of changing the working position without additional sealing problems. This outer or inner radially sealing spherical work chamber wall may be joined to the control part or cycloidal part and rotate with it, and it centers the parts relative to one another.

A further advantageous feature of the invention is its use as a compressor with rpm-independent control, particularly by changing the phase displacement of the two rotating parts relative to the conduits of operating media. Aside from the advantageous great centrifugal stability of the moving parts and the small dimensions with high machine power, the phase displacement makes it possible to control the sealing ratio in infinitely graduated fashion, and in particular independently of rpm. As a result, such a compressor is especially well-suited for supercharging of internal combustion engines, because that involves high rpm and above all highly variable rpm; the mass of the supercharger should also be as low as possible, in particular the rotating masses that have to be driven, and the power must be regulated independently of the rpm. Because of the capability of phase-displaced operation of a plurality of pairs of work chamber, and the capability of valveless control in the flow direction (without a reversal of the flow) and of the very good sealing quality of the work chambers, the compressors according to the invention can be used in pressure ranges in which until now only piston engines could be used.

Another advantageous feature of the invention is its use in the hydrostatic field as a pump, engine or gear. Once again, the extraordinarily favorable ratio between the structural size and the volumetric turnover has its effect. The simple kinematics, the rpm strength of the construction and the very large cross sections of the scavenging conduits makes these machines or engines suitable even for the highest rotational speeds.

The internal flow resistance of the machine or engine according to the invention is extremely low. If it is used as a pump, the high dimensional rigidity of the parts has an advantageous effect. Moreover, the only effect of wear is in how a kind of grinding-in, or reseating, between the moving parts occurs. Moreover, the machine or engine is suitable for the highest possible operation pressures. If used as an hydraulic motor, the same advantages are operative, and especially the low masses to be accelerated, the good start up performance, and the high volumetric efficiency. When used as a hydrostatic gear, the small structural volume is especially advantageous, as is the compact connectability of the pump and the hydraulic motor.

A further advantageous feature of the invention is its use as an engine or refrigeration machine, particularly by the Sterling principle. In the latter, the work chambers associated with one another operate with 90° phase displacement. Two rotating cycloidal parts in combination with a rotating control part form pairs of chambers that each operate phase-displaced by 90° from one another. One chamber is impinged upon by heat and the other is cooled; a regenerator is integrated with the control part. In accordance with the design of the invention, there are no parts that alternate between the hot and cold regions. The walls of the cold and hot work chambers are isolated from one another even though they are close together spatially. An extremely feasible ratio between the convection surface area and work chamber volume is possible, because of the high dimensional rigidity of the parts that form the work chambers. One of the rotating parts may be embodied as a rotor of a linear generator of the Sterling engine or of a linear motor of the Sterling refrigeration machine. It is accordingly possible to hermetically seal off the machine or engine and to design it for a very high charge pressure with low leakage losses of the operating gas. The phase displacement that determines the power of the Sterling motor is very simply achieved in this structural form. In any case, with a refrigeration machine designed in this way, the quantity of heat transported can be regulated independently of the rpm.

Further advantages and advantageous features of the invention may be learned from the ensuing description, drawing and claims.

BRIEF DESCRIPTION OF THE DRAWINGS

Three exemplary embodiments and variants of the same subject of the invention are shown in the drawings and described in detail below. Shown are.

DETAILED DESCRIPTION OF THE DRAWINGS

Figure 1:
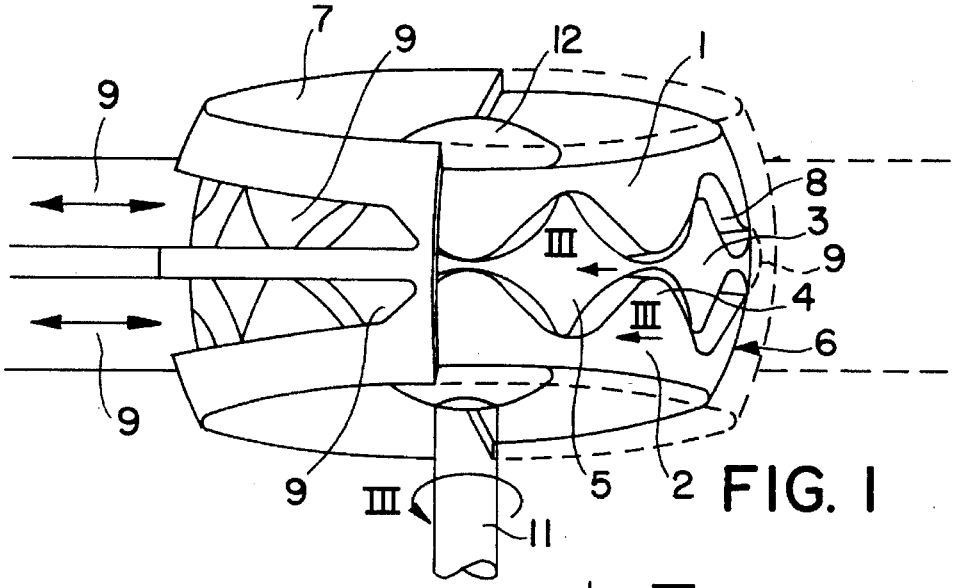
FIG. 1, the first exemplary embodiment as an hydraulic pump, highly simplified, in an X-ray viewed radially from the side on which the work chambers are the smallest.
Figure 2:
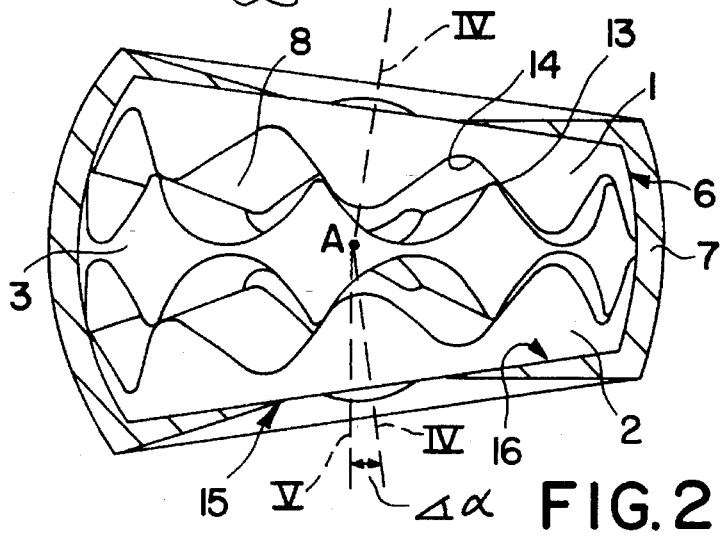
FIG. 2, a corresponding view but rotated by 90°.
Figure 3:
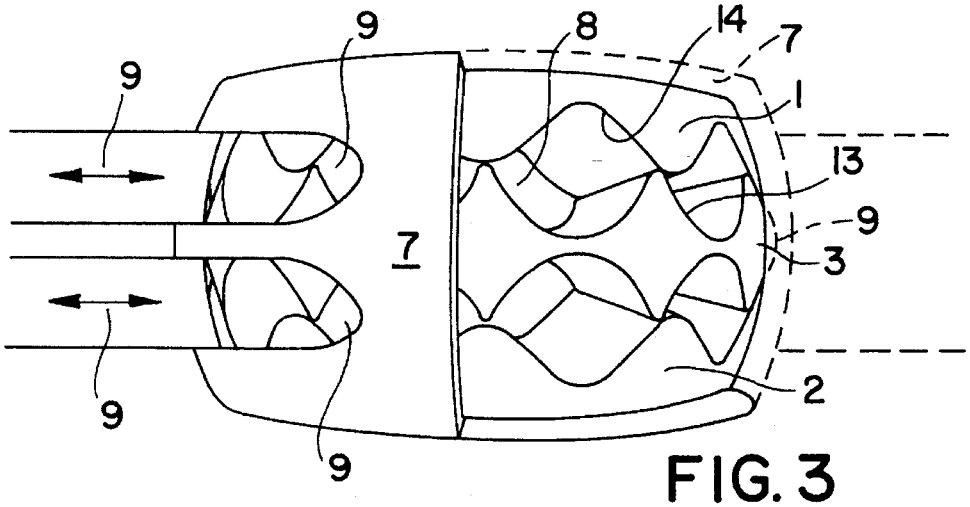
FIG. 3, a corresponding view but rotated by 180°, where the work chambers are largest.

As the first exemplary embodiment, FIGS. 1–3 show a feed pump in three radial elevation views, each rotated by 90°. This feed pump has two rotating conical gears 1 and 2, between which a conical gear 3 is disposed. While the conical gears 1 and 2 have a set of teeth 4 pointing toward one another, with a cycloidal course of the tooth surface in the section taken in the direction of rotation, the conical gear disposed between them is provided on both sides with teeth 5 that mesh with the teeth 4 of the main gears 1 and 2.

The conical gear 3 has one tooth 5 fewer on both sides than the number of teeth 4 that the conical gears 1 and 2 have, so that as FIGS. 1 and 2 especially show, an asymmetrical disposition of the teeth 5 between the teeth 4 is the result.

The radial jacket face 6 of all three rotary parts, namely the conical gears 1 and 2 and the conical gear 3 is embodied spherically and is radially sealingly guided in a housing 7 that is correspondingly spherical embodied on its inner wall. Pumping conduits 9 for supplying and removing liquid are present on the housing 7, opposite the work chambers 8 also defined by the teeth.

The conical gear 3 has a drive shaft 11, which as a power part is driven by means, not shown, such as an electric motor and in the process carries the conical gears 1 and 2, acting as a blocking part, along with it in the direction of the arrow III. The conical gear 3 is disposed on a ball 12 that is connected to the drive shaft 11, and on this ball the two conical gears 1 and 2 are provided with correspondingly conical recesses provided on them. As a result, a relative swiveling motion among all three rotational parts is possible.

As can be learned from FIG. 2, the axis of rotation IV of the two conical gears 1 and 2 is inclined relative to the axis of rotation V of the conical gear 3 by a certain operating angle, so that as a result, as can be seen from FIG. 2, the work chambers 8 vary from a minimum volume on the right-hand side to a maximum volume on the left-hand side. In the invention, the capability (not shown) advantageously exists of shifting the operating angles of the axis of rotation IV of the conical gears in different directions with respect to the axis of rotation V of the conical gear 3, as a result of which the functional capabilities referred to at the outset are expanded accordingly.

In FIG. 3, the X-ray view is aimed at the rotary piston machine from the side on which the work chambers 8 are the largest, in contrast to FIG. 1 in which the work chambers are the smallest.

In each case, the tooth cogs 13 of the teeth 5 of the conical gear 3 slide in a constant, linear positive engagement motion along the flanks 14 of the teeth 4 of the conical gears 1 and 2, and thus define and vary the respective work chambers 8. In the direction of rotation III shown, on the side shown in FIG. 2, the volume of the work chambers 8 is increasing, so that this represents the suction side of the pump. The compression side, conversely, would be the right half of the machine or engine shown in FIG. 1, and the left half in FIG. 3.

The axis of rotation of the extension, extending transversely to the direction of rotation, of the conical gears of the running surfaces of the teeth that goes through the center point A, which is both the center of the housing and of the ball 12, and moreover, the intersection of the axes of rotation IV of each of the conical gears 1 and 2 and V of the axis of rotation of the conical gear 3.

By the use of a spherical gear 3, with a difference in number of teeth from the conical gears 1 and 2, a nonpositive engagement with the two conical gears 1 and 2 is also brought about, so that synchronized rotation results from the drive of the conical gear 3.

The conical gears 1 and 2 are supported in the outset position on their bearing side 15 remote from the teeth 4 and 5 on a bearing face 16 of the housing 7; a slide bearing or roller bearing is provided between these faces. By the magnitude of the operating angle $\alpha$ and the resultant inclination relative to one another of the bearing faces 16, the magnitude of the transverse force is determined, whose tangential component produces the torque.

Figure 4:
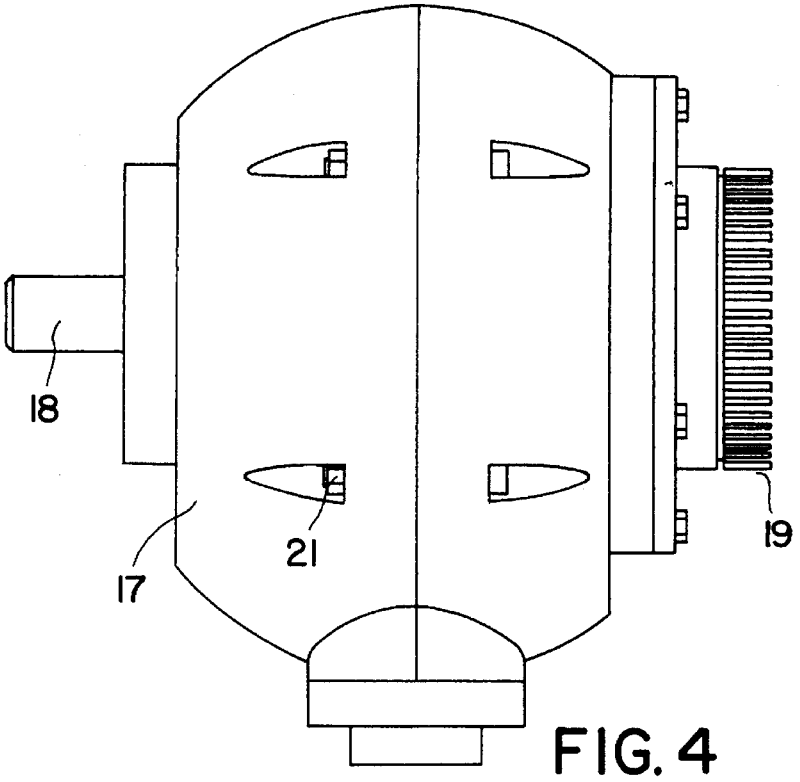
FIG. 4, the second exemplary embodiment as a pumper compressor, in an elevation view.

FIGS. 4–8 show a second exemplary embodiment, which can be used as either a pump or a compressor. In FIG. 4, this exemplary embodiment of the invention is shown in a side view; on one side, the drive shaft 18 protrudes from the housing 17, and on the other a spur gear 19, by way of which the volumetric efficiency per revolution can be adjusted, for instance the feed capacity for a pump or the operating pressure for a compressor. The housing 17 comprises two halves fastened together by screws 21.

Figure 5:
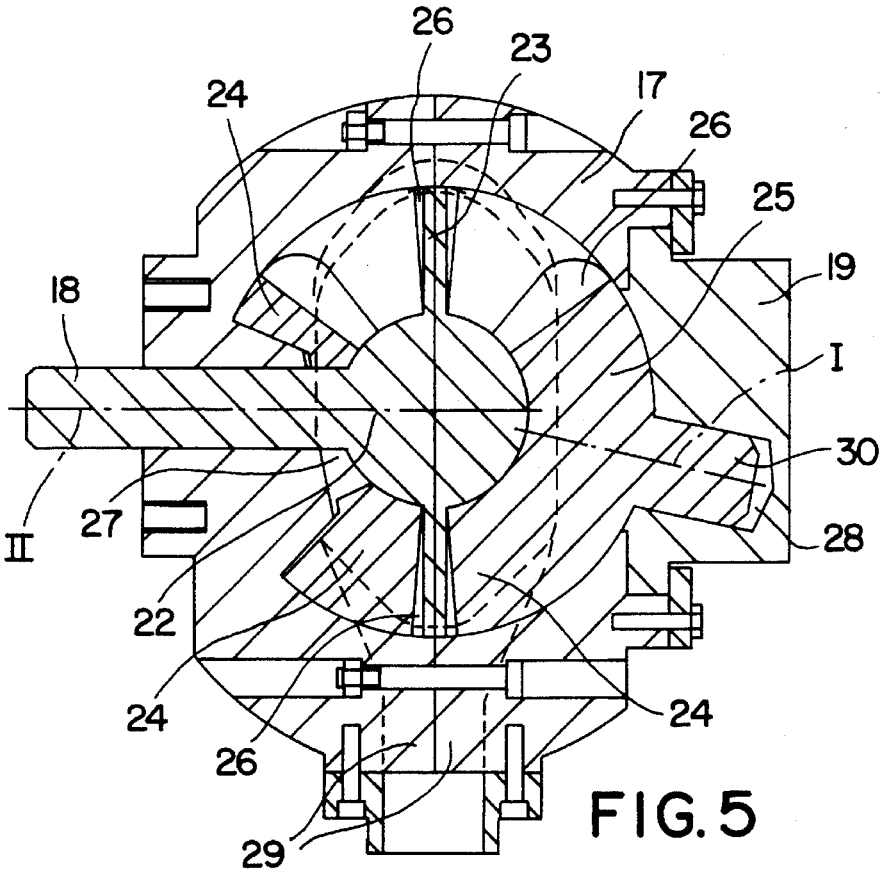
FIG. 5, a longitudinal section through the example of FIG. 4.

In the section shown in FIG. 5, the moving parts disposed inside the housing 17 are shown in longitudinal section. The drive shaft 18 is connected to a central ball 22, radially outward on which a control part 23 is embodied as a ring. This control part is especially shown in three-dimensional perspective in FIG. 8. Between the ball 22, the control part 23 and the housing 17, two cycloidal parts 24 and 25 are present, which define the work chambers 26. A tang 30 is disposed axially on the cycloidal part 25, which the cycloidal part 24 has an opening 27 for the passage of the drive shaft 18. The tang 30 of the cycloidal part 25 is disposed obliquely in terms of its axis of rotation I to the axis of rotation II of the drive shaft 18 and is supported in a corresponding obliquely extending line bore 28 of the spur gear 19. Upon rotation of the spur gear 19, the axis of rotation I describes a circular cone. Conduits 29 are also provided in the housing 17 for supplying and removing the operating medium; they have a communication with the work chambers 26 that is controlled upon rotation of the control part 23. When the axis of rotation I of the cycloidal part 25 is adjusted by rotation of the spur gear 19, the operating phase of the work chambers 26 is shifted with reference to the control conduits 29 and also with reference to the work chambers 26 located on the other side of the control part. Additional conduits are provided in the control part 23 and possibly in the housing 17 as well, in order to enable the passage of the operating medium either from one of the work chambers 26 to another or on the other side of the control part 23, or serve as compensation control connections.

Figure 6:
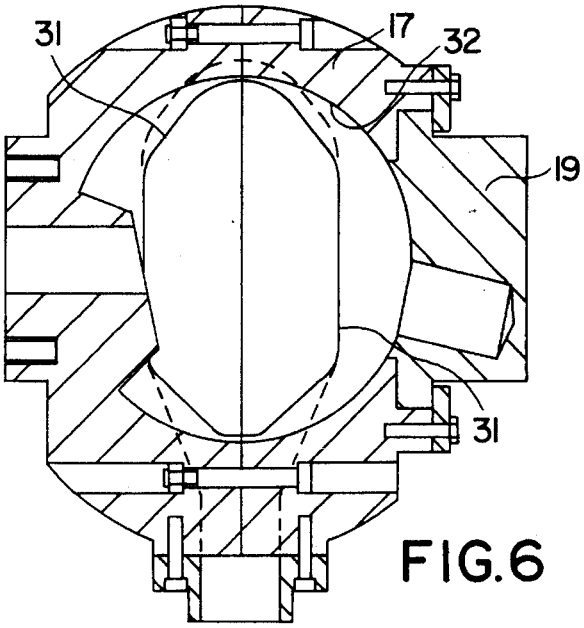
FIG. 6, the same longitudinal section as in FIG. 5 but without the moving parts.

In the housing shown in FIG. 6, the control edge 31 is a part of the housing and cooperates with gears 23, 24, 25 to control the flow of fluid through the housing and the spherical embodiment of the inner wall of the housing can also be seen.

Figure 7:
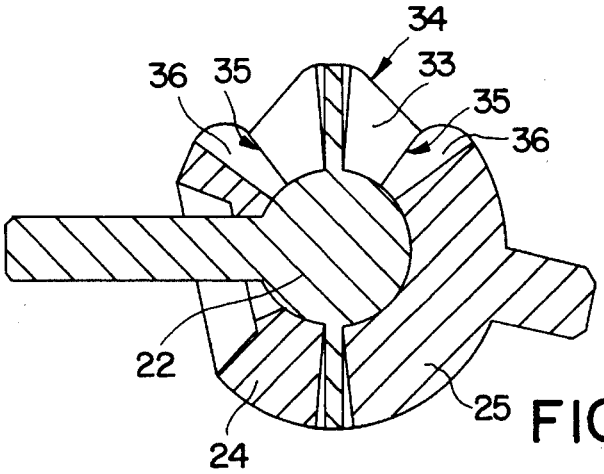
FIG. 7, the moving parts of FIG. 5 in longitudinal section.

As shown in FIG. 7, the flank 33 of the teeth 34 of the control part 23 changes into tooth cogs 35, which travel on the rolling surface 36 of the cycloidal parts 24 and 25. This is brought about, as discussed above, by the indication difference in number of teeth.

Figure 8:
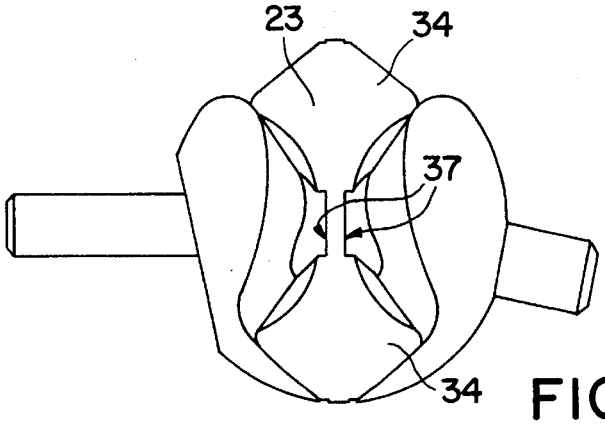
FIG. 8, the moving parts of FIG. 5 in a perspective view.

In the perspective view of these rotating parts chosen in FIG. 8, a tapering of the connecting ligaments, located between the respective teeth 34 of the control part, in the form of a milled-out recess 37, on both face ends of this control part. This milled-out recess extends from the outer periphery as far as the ball 22 and creates an artificial idle space, and as a result in a known manner crush losses are averted.

Figure 9:
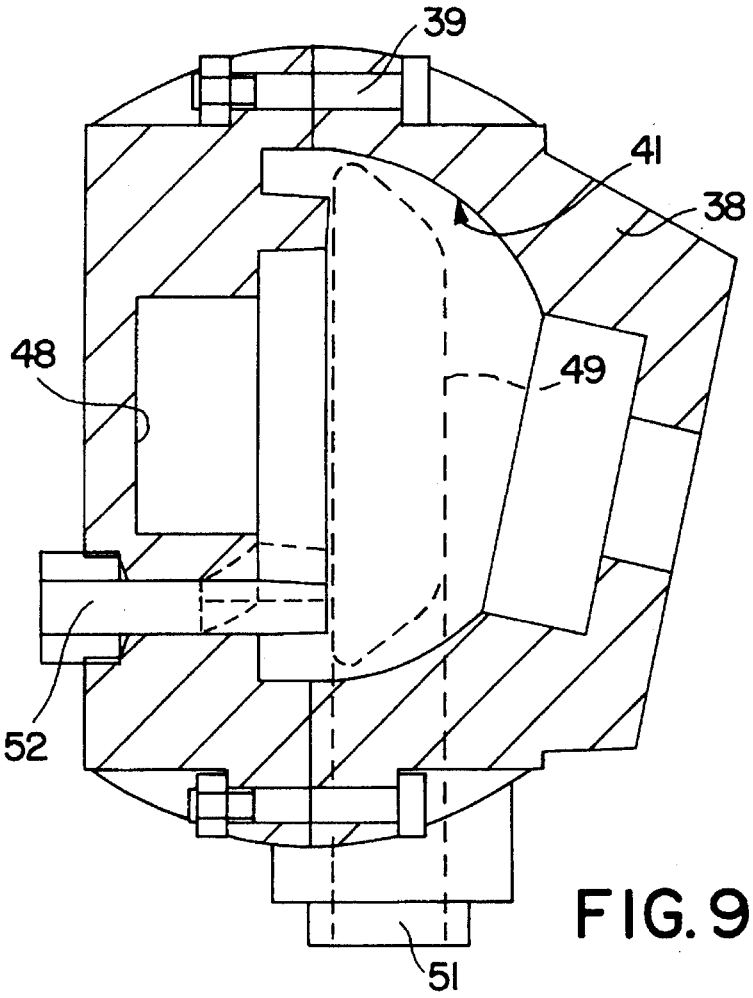
FIG. 9, the third exemplary embodiment as a compressor, in longitudinal section without the moving parts.
Figure 10:
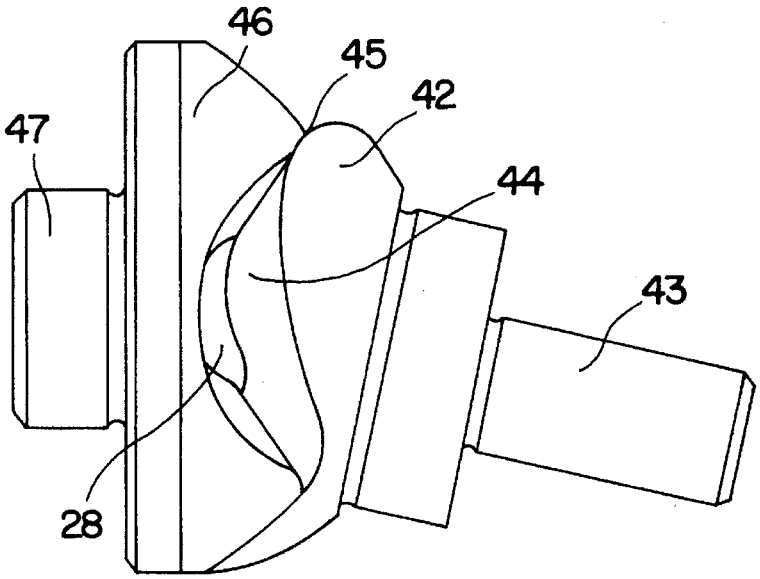
FIG. 10, an elevation view of the moving parts of the example of FIG. 9.

In FIGS. 9 and 10, a further exemplary embodiment, particularly for a compressor, is shown, specifically the housing in longitudinal section in FIG. 9 and the rotating parts in a perspective view in FIG. 10. Once again, the housing 38 is embodied in two parts and fastened together by screws 39. The interior has a spherical inner wall 41 on only one side, over which wall a cycloidal part 42 travels in radially sealing fashion. This cycloidal part 42, which is driven to rotate by a drive shaft 43, cooperates, by its running surface 44 that is cycloidal in development, with the teeth 45 of a jointly driven control part 46. The control part 46 is guided in a blind bore 48 of the housing 38 via a tang 47. Control conduits 49 are present, indicated by dashed lines, in the inner wall of the housing 38, and their communication with the work chambers 28 is controlled via the teeth 45 of the control part 46. A suction connection 51 and a pressure connection 52 for the operating medium are provided in the housing 38 and are each connected to the control channels 49. The channels 49 are formed within the housing and cooperate with the gears 42 and 46 in order to control the flow of fluid through the housing.

Figure 11A:
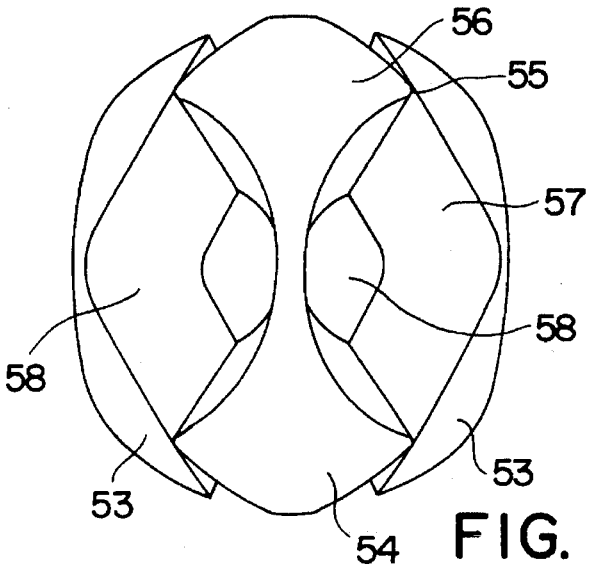
FIGS. 11*a*, 11*b* and 11*c* illustrate a perspective view of the rotating parts in three elevation views 11*a*, 11*b*, 11*c* for purposes of basic explanation.
Figure 11B:
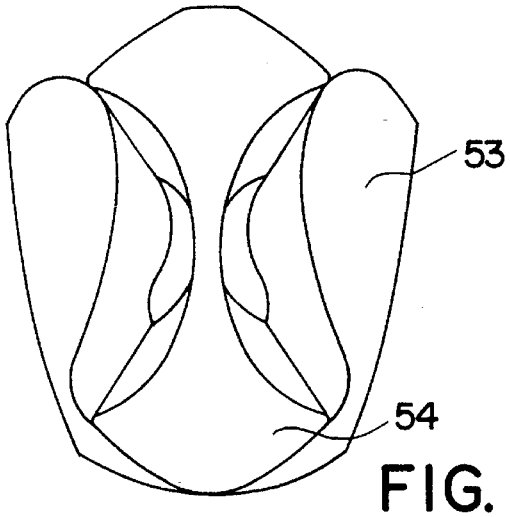
Figure 11C:
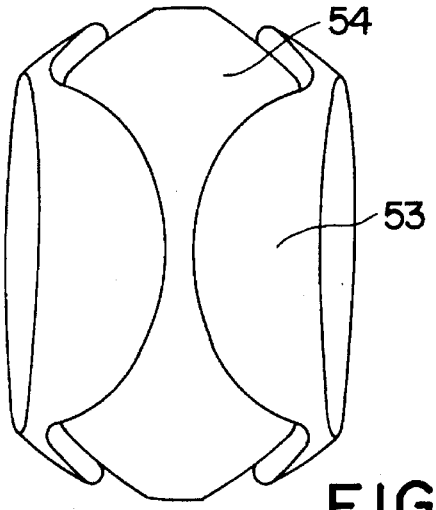
Figure 12A:
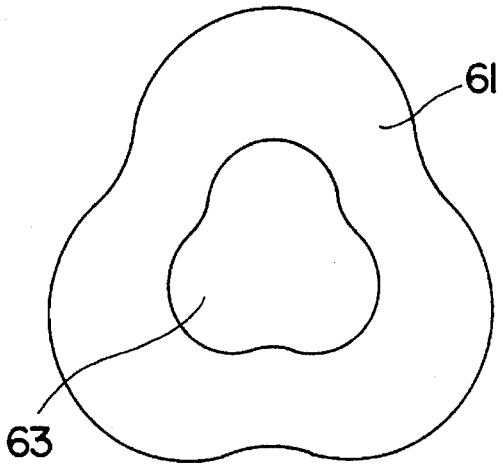
FIGS. 12*a*, 12*b*, 12*c* and 12*d* illustrate perspective views as well as the plan views 12*a*, 12*b*, 12*c*, 12*d* of the rotating parts for the purposes of fundamental explanation.
Figure 12B:
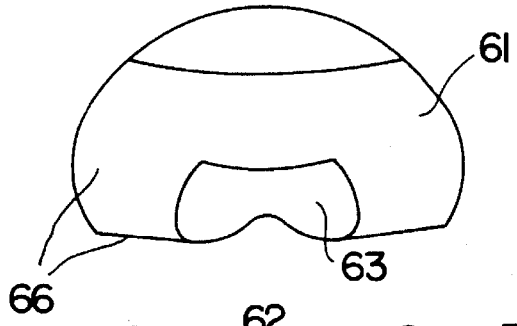
Figure 12C:
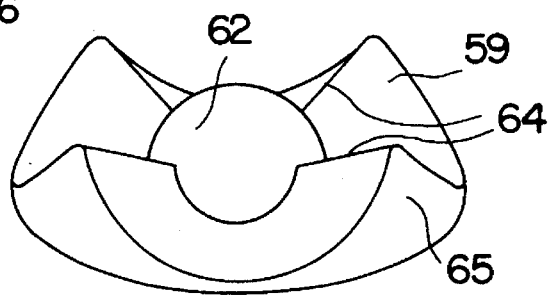
Figure 12D:
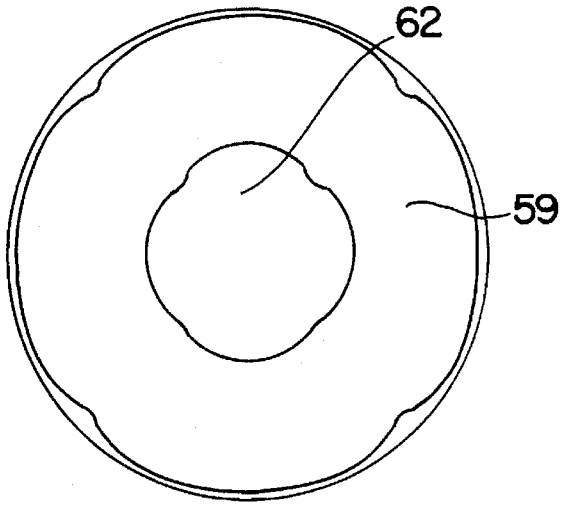

The fundamental operation of the rotary piston pump according to the invention is explained hereinafter in conjunction with FIGS. 11*a*, 11*b*, 11*c* and 12*a*, 12*b*, 12*c* and 12*d*. FIGS. 11*a*, 11*b* and 11*c* in three different elevation views show the association of the three rotating parts of a dual-action design. Between two cycloidal parts 53, which have a spherical segmental surface on the outside for sealing off from a corresponding housing, a control part 54 is disposed, which with the cogs 55 of its teeth 56 travels over the cycloidal surface 57. As can be learned from the three views 11*a*, 11*b* and 11*c*, each offset from one another by 90°, the work chambers 58 disposed between the rotating parts have a maximum volume in view 11*a*, which changes to a reduced volume in view 11*b*, to a zero volume in view 11*c*. As the three parts rotate, the maximum volume arises in each case in the region of view 11*a* and changes through view 11*b* to view 11*c* to become a zero volume. The operating medium aspirated or positively displaced in the process is, as described above, supplied or removed by controlling conduits by the control part 54, this control being virtually offered by the rotation. The phase displacement mentioned in conjunction with the second exemplary embodiment can be illustrated in drawing terms for instance by combining the left-hand side of view 11*a* with the right-hand side of view 11*c*, so that in a short-circuit connection, only a shifting back and forth of the operating fluid would become established, which is known as "O feeding."

The view in FIG. 12 serves to explain a single-stage pump according to the invention, in which a four-toothed control part 59 in accordance with view 12*c* cooperates with a cycloidal part 61 of view 12*b* that has protrusions and recesses. The ball 62 acts to define the work chamber and also has a guiding function in a spherical recess 63. This illustration is made clear by the respective internal view 12*a* and 12*c*. When the control parts 59 and cycloidal part 61 jointly rotate, the cogs 64 of the teeth 65 travel on the cycloidal path 66 of the cycloidal part 61.

All the characteristics shown and described in the description, the following claims and the drawing, may be essential to one another either individually or in any arbitrary combination with one another.

I claim:

1. A rotary piston machine, which functions as a pump, compressor or engine, having a housing which includes an inlet and an outlet which include control conduits (9), a conical gear (3, 23, 42, 54) supported both axially and radially and connected to a driving or driven apparatus (11, 18, 43), said conical gear including gear teeth (5) on opposite sides thereof, first and second gears having a radial sealing diameter, each of said first and second gears including gear teeth (4) on at least one side, means for a radial sealing and guidance of the first and second gears in said housing (7, 17, 38), an inclination of an axis of rotation (IV) of each of the first and second gears relative to an axis of rotation (v) of said conical gear in which the inclination of the axis of each of said first and second gears relative to the axis of said conical gear is (α), work chambers (8, 26, 58) are located between the gear teeth (4) on each of said first and second gears and the gear teeth (5) on opposite sides of said conical gear (3), a volume of the work chambers (8, 26, 58) alternatingly increases and decreases during rotation of said first and second gears and said conical gear up to a predetermined value, and a plurality of flanks (14) of said teeth (4) on said first and second gears have a positive engagement, with a plurality of tooth cogs (13, 35) of the teeth (5) on said conical gear to define said work chambers, the teeth of the first and second gears intermesh with the teeth on the conical gear and are embodied as a cycloidal surface with a cycloidal development of an intermeshing surface (14, 36, 57), that the teeth (5) of the conical gear meshingly cooperate with the cycloidal surface of each of said first and second gears and have a difference of one tooth in the number of teeth relative to the cycloidal surfaces and said conical gear (3) serves as a control part (3, 23, 46, 54, 59), that said conical gear (3, 23, 4, 54, 59) controls said control conduits (9) present in the housing (7, 17, 38), and that a plurality of tooth cogs (13, 35) of said conical gear (3, 23, 46, 54, 59) rotate relative to the cycloidal surface, and revolve along the plurality of flanks (14, 36, 44) of the teeth (4) of the cycloidal surface.

2. The rotary piston machine of claim 1, in which said plurality of tooth cogs (13, 35) are transverse to a rotational direction of said conical gear and form meshing surfaces of the cycloidal surface and extend in an extension through an intersection (A) of the axis of rotation (IV) of each of said first and second gears.

3. The rotary piston machine of claim 2, in which the working position of the axes of rotation (IV and V) of the first and second gears and said conical gear is variable independently of one another by varying a position of a spur gear (19) which is mechanically connected with a tang (30) of a cycloidal part (25).

4. The rotary piston machine of claim 2, in which said control conduits (9, 29, 52) are present in the housing for supplying or removing an operating media.

5. The rotary piston machine of claim 2, which includes two of the cycloidal surfaces and between said cycloidal surfaces, said conical gear is provided with a set of radial teeth or cycloidal meshing surfaces on opposite sides of said conical gear.

6. The rotary piston machine of claim 5, in which at least two work chambers (8, 26, 58) are present, one each on opposite sides of the conical gear (3, 23, 54) which are made to communicate with one another via a connecting conduit.

7. The rotary piston machine of claim 2, in which a radial jacket face of the first and second gears is spherically embodied, and is radially sealingly guided on a corresponding spherically embodied inside face of the housing.

8. The rotary piston machine of claim 1, in which the working position of the axes of rotation (IV and V) of the first and second gears and said conical gear is variable independently of one another by varying a position of a spur gear (19) which is mechanically connected with a tang (30) of a cycloidal part (25).

9. The rotary piston machine of claim 8, which includes two of the cycloidal surfaces and between said cycloidal surfaces, said conical gear is provided with a set of radial teeth or cycloidal meshing surfaces on opposite sides of said conical gear.

10. The rotary piston machine of claim 9, in which at least two work chambers (8, 26, 58) are present, one each on opposite sides of the conical gear (3, 23, 54) which are made to communicate with one another via a connecting conduit.

11. The rotary piston machine of claim 8, in which said control conduits (9, 29, 52) are present in the housing for supplying or removing an operating media.

12. The rotary piston machine of claim 8, in which a radial jacket face of the first and second gears is spherically embodied, and is radially sealingly guided on a corresponding spherically embodied inside face of the housing.

13. The rotary piston machine of claim 1, which includes two of the cycloidal surfaces and between said cycloidal surfaces, said conical gear is provided with a set of radial teeth or cycloidal meshing surfaces on opposite sides of said conical gear.

14. The rotary piston machine of claim 13, in which at least two work chambers (8, 26, 58) are present, one each on opposite sides of the conical gear (3, 23, 54) which are made to communicate with one another.

15. The rotary piston machine of claim 13, in which said control conduits (9, 29, 52) are present in the housing for supplying or removing an operating media.

16. The rotary piston machine of claim 1, in which said control conduits (9, 29, 52) are present in the housing for supplying or removing an operating media.

17. The rotary piston machine of claim 1, in which a radial jacket face of the first and second gears is spherically embodied, and is radially sealingly guided on a corresponding spherically embodied inside face of the housing.

18. The rotary piston machine of claim 1, in which the first and second gears are used as a compressor, with rpm-independent control, and operates as a compressor by displacing operating phases of the first and second gears rotating relative to the control conduits of the housing.

19. The rotary piston machine of claim 18, in which said first and second gears are driven from outside and axially supported in the housing and said conical gear is provided with teeth on opposite sides and disposed between cycloidal teeth on each of said first and second gears, and that a tooth arrangement on said conical gear is offset on one side from another side in a direction of rotation.

20. The rotary piston machine of claim 1, in which the first and second gears and said conical gear are used in a hydrostatic field as a pump or engine.

21. The rotary piston machine of claim 1, in which the first and second gears and said conical gear are used as an engine or refrigeration machine, wherein the work chambers associated with one another cooperate with a 90° phase displacement relative to each other.

* * * * *